United States Patent [19]

Silver

[11] Patent Number: 4,978,044

[45] Date of Patent: Dec. 18, 1990

[54] SLIDABLY ENGAGED LUGGAGE STRAP

[75] Inventor: Albert L. Silver, Palm Springs, Calif.

[73] Assignee: Ruth Silver and Company, Calif.

[21] Appl. No.: 356,132

[22] Filed: May 24, 1989

[51] Int. Cl.[5] ..... A45F 3/02

[52] U.S. Cl. ..... 224/202; 224/257; 224/264; 294/149; 150/108

[58] Field of Search ..... 224/151, 191, 202, 205, 224/257, 258, 264, 101; 190/1, 101, 102, 116, 118; 150/108, 107, 102; 294/137, 149, 167, 170; 229/52 A; 16/110 R, 110.5, 114 R, 125

[56] References Cited

U.S. PATENT DOCUMENTS

| | | | |
|---|---|---|---|
| 292,940 | 2/1884 | Nickerson | 190/101 |
| 1,468,711 | 9/1923 | Dwyer | 150/108 |
| 1,631,694 | 6/1927 | Rick | 224/264 |
| 2,893,549 | 7/1959 | Jensen | 229/52 A |
| 4,541,540 | 9/1985 | Gretz et al. | 224/202 |
| 4,649,973 | 3/1987 | Uchin | 224/202 |
| 4,811,768 | 3/1989 | Williams | 224/205 |

*Primary Examiner*—Linda J. Sholl

[57] ABSTRACT

The luggage strap shown has escape prevention means (from the closed luggage to be carried) which often comprise areas of fabric doubled back on itself and sewn to form a gather. The escape prevention means stop the strap from sliding further out through closed confronting edges of the luggage.

12 Claims, 1 Drawing Sheet

SLIDABLY ENGAGED LUGGAGE STRAP

BACKGROUND OF THE INVENTION

1. Field of the Invention

This invention relates to luggage straps, and particularly, to a luggage strap that is slidably engaged by the closing edges of a closeable container that confront each other, but which has means to prevent the total escape of the strap through said closed edges. More particularly, the invention concerns an elongated fabric band wherein an area of fabric is doubled back on itself to provide means to prevent the total escape of the band from a closed container, while other parts of the band can slide through the closed edges of the container that confront one another.

2. Description of the Prior Art

Shoulder straps to carry items of luggage are especially well known for modern day luggage such as garment bags. Such straps usually have buckles at the ends that engage loops sewn on to the outside of the luggage. Even when the straps were detached from the luggage, the loop remained and provided a rough and sharp surface that could mar other luggage, as well as scratch the hands of the user. Furthermore, the stress placed upon the loop attachment to the luggage often led to detachment of the loop from the luggage. The buckle on the end of the luggage strap also made convenient storage of the luggage strap, when not engaged in the loop on the luggage, difficult due to the increased bulk and hardness of the buckle.

Problems still remain with the convenience of a detachable luggage strap. In addition to the problems noted with storage and with the loop on the luggage itself tearing out, the cost of manufacturing and attaching the loop and buckle raises the cost of the item. Thus, there still is a need for a simple luggage strap that does not depend upon metallic hardware to attach to the luggage item. Also needed is a luggage strap that can be conveniently stored either inside the luggage, or on the surface in a pouch of reduced thickness.

OBJECTS AND SUMMARY OF THE INVENTION

An object of the present invention is to provide a luggage strap which is easy to manufacture and does not contain metallic attachment hardware.

It is a further object of this invention to provide a luggage strap that does not attach to a metallic loop that needs to be sewn into the surface panel of the luggage.

It is yet another object of this invention to provide a luggage strap which may be conveniently stored in the luggage, or in a pouch on the outside surface of the luggage.

This invention provides a strap for carrying a closeable container with closing edges that confront each other comprising an elongated band with means loosely disposable between said edges to prevent the escape of said band between said closed edges from the interior of said container, said escape prevention means disposed relative to a position along said band.

The novel features of construction and operation of the invention will be more clearly apparent during the course of the following description, reference being had to the accompanying drawings wherein there is illustrated a preferred form of the invention, and wherein like characters of reference are employed to denote like parts throughout the drawings.

DETAILED DESCRIPTION OF THE FIRST PREFERRED EMBODIMENT

Figure 1:
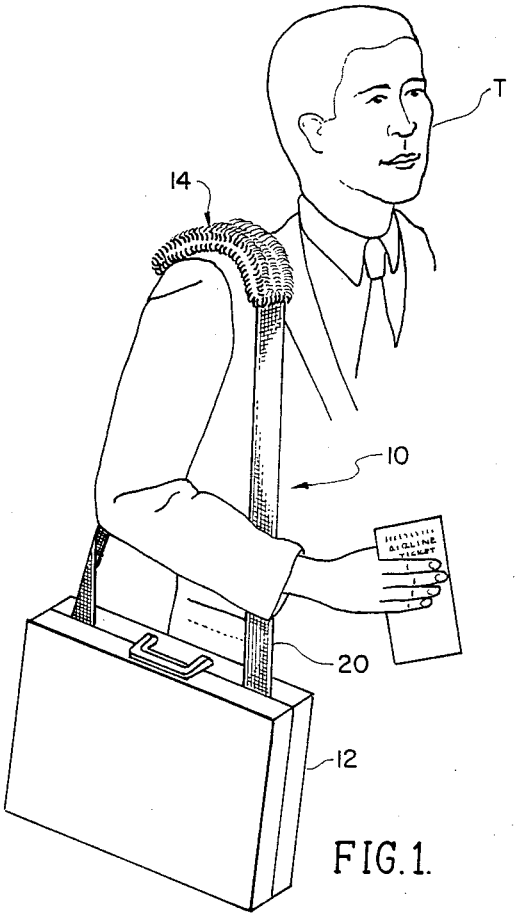
FIG. 1 is a perspective view of the luggage strap as it would be utilized by a user carrying an attache case under one shoulder.

Referring now to FIG. 1, a perspective view of the instant invention the use, in this case traveler T, is shown utilizing the strap 10 as a sling to carry an attache case 12. To ease the discomfort of carrying a possibly heavy closed container, attache case 12, a shoulder pad 14 is provided. This shoulder pad cushions the impact and strain of strap 10 on the user's shoulder.

Figure 2:
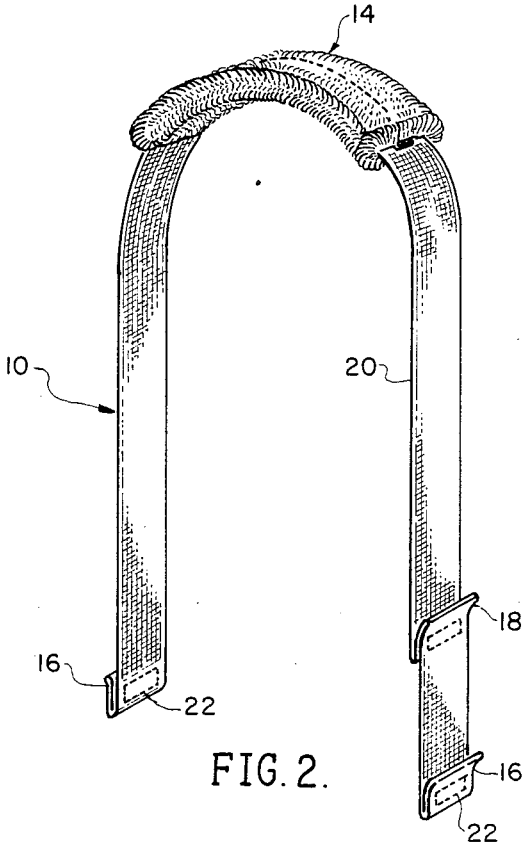
FIG. 2 is a perspective drawing of the luggage strap with an optional shoulder pad.

Referring now to FIG. 2, a perspective view of the strap 10, shoulder pad 14 is seen at the top of the strap 10. The strap 10 is displayed in the form of an arch as though it were attached to a closed container, such as attache case 12, and draped over the shoulder of a user. However, the closed container is not illustrated. The strap 10 is seen to contain escape prevention means 16 which are at the ends of elongated band 20. Also illustrated is secondary escape prevention means 18 which is disposed above end escape prevention means 16. Secondary escape prevention means 18, if strap 10 is laid flat, would be disposed between end escape prevention means 16 which are at each end of elongated band 20.

Referring again to FIG. 2, it can be seen that both end escape prevention means 16 and secondary escape prevention means 18 comprise an area of fabric of elongated band 20 that has been doubled over, and then sewn together by stitching 22. The fabric can be sewn together so as to form a gather. The fabric can be of the type used to make car seat belts which is woven from nylon fibers. Such fabric has a strength of 2,880 lbs. The surface of the fabric presents a slippery feel and slides, i.e., escapes, between and through the closed confronting edges of the container. Alternative means of making the doubled over area of fabric stick together include gluing, stapling, or using a slide-on clip.

Figure 3:
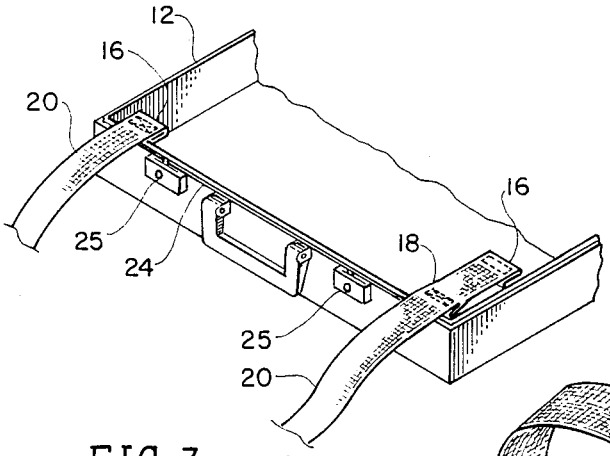
FIG. 3 is a perspective view of the luggage strap as it is being put into an attache case prior to closing the confronting closing edges.

Referring now to FIG. 3, an illustration of how strap 10 is put into an open container such as attache case 12, it can be seen that the end escape prevention means 16 and secondary escape prevention means 18 are placed next to the confronting edge 24 of attache case 12. In FIG. 3, the end escape prevention means 16 and secondary escape prevention means 18 have been previously placed in the appropriate position. Then the lid of attache case 12 is brought down on top of the elongated band 20 and a matching confronting edge of the lid of attache case 12 is then forced into close proximity with the illustrated confronting edge 24. The proximity must be close enough to allow the latches 25 to securely close the attache case 12. When the lid is shut onto the lower half of attache case 12, illustrated in FIG. 3, the elongated band 20 passes through the remaining gap between the confronting edge 24 and the unillustrated confronting edge of the lid of attache case 12. It should also be understood that when the lid, or any other matching container half, is closed on to elongated band 20, with the appropriate choice of fabric for elongated band 20, the elongated band 20 can be pulled through the gap between the two confronting edges 24 until an escape prevention means area is reached. Pulling the band through the gap can be facilitated by choosing the previously mentioned nylon fabric with a slippery surface. Because both the end escape prevention means 16 and the secondary escape prevention means 18 are thicker than elongated band 20, the travel of the elongated band 20 is stopped and the end escape prevention means 16 and, possibly, secondary escape prevention means 18 also then provide a load bearing area on the strap 10. The load bearing areas then shift the load to the area of the elongated band 20 that runs over the shoulder of the user. If optional shoulder pad 14 is present, the shoulder pad 14 can distribute the load more evenly over the top shoulder area of the user for greater comfort.

It should also be understood that the optional secondary escape prevention means 18 allows for adjustment of strap 10 to fit various heights of users. The optional secondary escape prevention means 18 also allows the same user to use the strap on different items of luggage. Specifically, shortening the amount of strap 10 outside of the closed container by using the secondary escape prevention means 18 to engage the confronting edges 24 of the attache case 12 or other luggage or closed container, allows the user to shorten the length of strap 10, and hence determine how low the luggage will be carried on the body of the user. Indeed, having many secondary escape prevention means 18 on both ends of the strap 10 would allow the user to utilize the strap 10 with a variety of pieces of luggage ranging from tall garment bags whose top edge must be carried very close to the armpit of the user, to attache cases 12 whose top edge may be lower on the body of the user.

Figure 4:
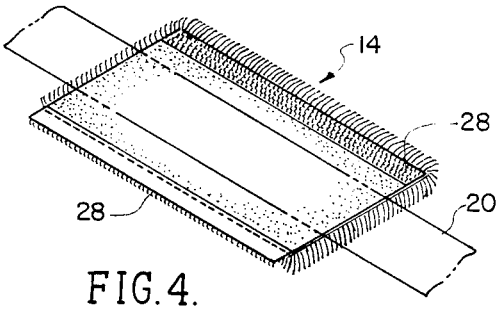
FIG. 4 is a top elevation of the shoulder pad with the elongated band shown in hidden view passing therethrough.

Referring now to FIG. 4, shoulder pad 14 is shown in its previously illustrated engagement with elongated band 20. Here elongated band 20 is shown in hidden view as passing through the center of shoulder pad 14.

DETAILED DESCRIPTION OF THE SECOND PREFERRED EMBODIMENT

Figure 5:
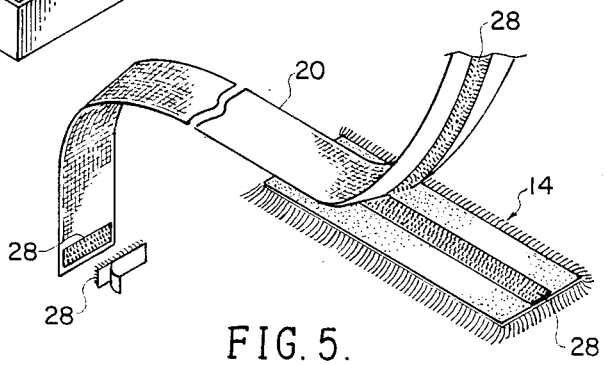
FIG. 5 is a perspective view of an alternative embodiment of both the shoulder pad and escape prevention means. Both the shoulder pad and escape prevention means are attached through utilization of matching VELCRO* adhering strips on the elongated band.

Referring now to FIG. 5, an alternative embodiment of the invention, elongated band 20 is shown to engage shoulder pad 14 through the use of mating VELCRO adhering strips 28. Additionally, escape prevention means, whether end means 16 or secondary means 18, are shown as VELCRO adhering strips 28 that replace stitching 22. The elongated band 20 is shown in FIG. 5 as having the VELCRO strips 28 serving only as end escape prevention means 16. However, it should also be understood that the mating VELCRO adhering strips 28 could be attached to another elongated band segment that could have additional escape prevention means on it.

It should also be understood that the escape prevention means, 16 and 18, could consist of metallic hardware such as an eye which would engage a hook that would be attached to an inside panel of the closed container. Any number of conventional attachment means could be used for the escape prevention means to engage the inside of the closed container. However, when such conventional attachment means are utilized, elongated band 20 can still slide through the gap between the confronting edges 24 to allow for easy engagement of strap 10 in a closed container.

The invention hereinabove described is, of course, susceptible of many variations, modifications and changes, all of which are within the skill of the art. It should be understood that all such variations, modifications and changes are within the spirit and scope of the invention and the appended claims. Similarly, the appended claims will be understood to cover all changes, modifications and variations of the example of the invention herein disclosed for the purpose of illustration. Likewise, the drawings and detailed description of the invention herein are disclosed for the purpose of illustration and should not be understood to limit the scope of the invention.

I claim:

1. A strap for carrying a closeable container with closing edges that confront each other comprising an elongated band made of fabric and an escape prevention means comprising an area of fabric doubled back on itself and fastened together at each end of said strap, the thickness of said fabric adapted to permit the band to escape through said closed edges, but the thickness of said band at said area of fabric doubled back on itself being too large to escape through said closed edges.

2. The strap of claim 1 wherein said fabric doubled back on itself is sewn together.

3. The strap of claim 2 wherein the area of fabric doubled back on itself forms a gather.

4. The strap of claim 1 wherein said thickness of said band is adapted to pass between the closed edges of an attache case, but said thickness of said band in said area of fabric doubled back on itself is too thick to pass through said closed edges.

5. The strap of claim 1 wherein said thickness of said band is adapted to pass between the closed edges of a suitcase, but said thickness of said band in said area of fabric doubled back on itself is too thick to pass through said closed edges.

6. The strap of claim 1 wherein said fabric has a strength of 2,880 lbs.

7. The strap of claim 1 wherein said fabric comprises nylon.

8. The strap of claim 1 wherein said fabric is drapable.

9. The strap of claim 1 wherein said strap has at least two escape prevention means at each end of said band.

10. The strap of claim 1 wherein said strap has a shoulder pad disposed between said escape prevention means.

11. The strap of claim 1 wherein said band can travel through said closed edges until said escape means contact said closed edges.

12. The strap of claim 1 wherein said escape means prevent further escape of said elongated band from said closed container and said elongated band defines a sling.

* * * * *